United States Patent [19]

Kienzle et al.

[11] 4,421,278

[45] Dec. 20, 1983

[54] INJECTION VALVE

[75] Inventors: Wolfgang Kienzle, Schwieberdingen; Rudolf Krauss, Stuttgart, both of Fed. Rep. of Germany

[73] Assignee: Robert Bosch GmbH, Stuttgart, Fed. Rep. of Germany

[21] Appl. No.: 481,178

[22] Filed: Apr. 1, 1983

Related U.S. Application Data

[63] Continuation of Ser. No. 276,126, Jun. 22, 1981, abandoned.

[30] Foreign Application Priority Data

Jun. 25, 1980 [DE] Fed. Rep. of Germany ..... 3023757

[51] Int. Cl.[3] ..... B05B 1/08; F02M 51/08

[52] U.S. Cl. ..... 239/533.12; 239/585

[58] Field of Search ..... 239/453, 533.2–533.12, 239/585

[56] References Cited

U.S. PATENT DOCUMENTS 1,755,192 4/1930 Scott ..... 239/533.7
2,439,832 4/1948 Voit ..... 239/453
2,771,321 11/1956 Alric ..... 239/533.11 X
2,921,746 1/1960 Burman ..... 239/453

FOREIGN PATENT DOCUMENTS 2241008 3/1975 France ..... 239/585

*Primary Examiner*—Andres Kashnikow
*Attorney, Agent, or Firm*—Edwin E. Greigg

[57] ABSTRACT

A fuel injection valve is proposed for fuel injection systems of internal combustion engines, which serves to supply fuel into the intake tubes of the engine. The injection valve includes a movable valve element which cooperates with a fixed valve seat. Downstream of the valve seat a bore is provided in the valve body. A charge controlling device in the form of an insert having a section having axially extending flutes thereon is pressed into the bore. The insert has a section on its end away from the fixed valve seat that functions as a metering section. The metering section has a diameter smaller than the internal diameter of the bore, with the metering of fuel taking place in the space thus provided. A diversion means downstream of the charge controlling device serves to divert fuel flow from a valve in a radially extending fan-type spray into an intake tube.

7 Claims, 3 Drawing Figures

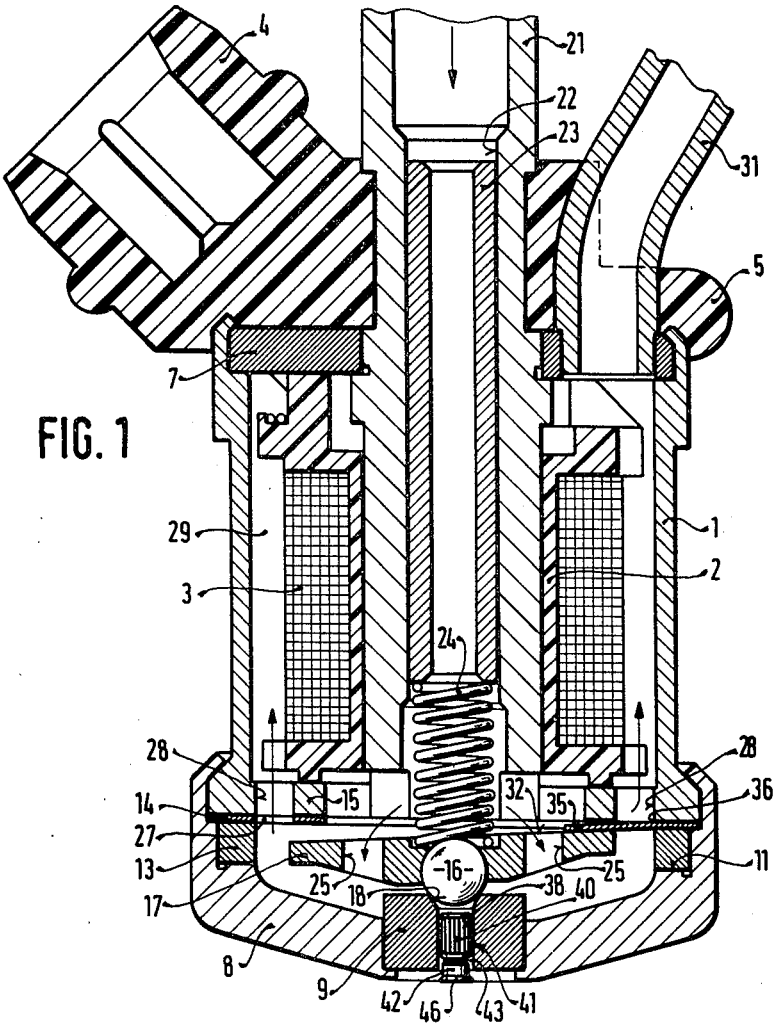
FIG. 1
FIG. 2
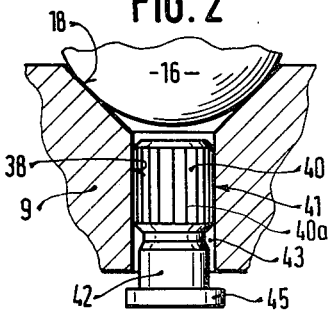
FIG. 3
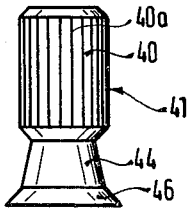

INJECTION VALVE

This is a continuation of application Ser. No. 276,126, filed June 22, 1981, now abandoned.

BACKGROUND OF THE INVENTION

The invention relates to an injection valve for fuel injection systems of internal combustion engines, the valve being in communication with an engine intake tube and having a movable valve element associated with a fixed valve seat body. Injection valves of the general type are known in the art. The known injection valve, however, has the disadvantage that the fuel is injected into the intake tube in a limited or nonuniform dispersal pattern.

OBJECT AND SUMMARY OF THE INVENTION

It is an object of the invention to provide an injection valve having an improved fuel spray pattern. The injection valve embodying the present invention is characterized in that a fixed valve seat body has a bore having a length extending downstream of the fixed valve seat. The bore provides an annular wall adapted to receive a charge controlling device. The charge controlling device is provided with land and groove zones with the land zone being arranged to secure said charge controlling device in said bore. The groove zone is adapted to control fuel flow through the bore. A diversion means downstream of the charge controlling device serves to divert fuel flow in a radially extending fan-type spray into the intake tube.

It is another object of the invention to provide an injection nozzle in which the fuel is still fully prepared for combustion even when the injection pulses are quite short.

The invention will be better understood and further objects and advantages thereof will become more apparent from the ensuing detailed description of a preferred embodiment taken in conjunction with the drawing.

BRIEF DESCRIPTION OF THE DRAWINGS

FIG. 1 is a cross-sectional view of an injection valve with a charge controlling device for preparation and controlled dispersion of fuel according to the invention; and FIG. 2 is an enlarged view of the lower end of an injection valve in part similar to FIG. 1 showing a further embodiment of a charge controlling device; and FIG. 3 is an enlarged view of the charge controlling device of FIG. 1.

DESCRIPTION OF THE PREFERRED EMBODIMENT

Referring now to the drawings, the fuel injection valve shown in FIG. 1, intended for use in a fuel injection system, serves to inject fuel, particularly at low pressure, into the intake tube of mixture-compressing internal combustion engines having externally-supplied ignition. A valve housing 1 is provided with a magnetic coil 3 disposed within it on a coil carrier 2. The magnetic coil 3 is supplied with current via an electrical plug connection 4, which is embedded in a plastic ring 5 fitted axially upon the valve housing 1 as a cap. A closure plate 7 is recessed into the end of the valve housing 1 beneath the plastic ring 5 and adjacent to the electrical plug connection 4. By means of flanging and then welding or soldering, this closure plate 7 can be attached to seal the valve housing 1 at this end. A nozzle carrier 8 is provided with flanges also to seal the valve housing 1 at the end of the fuel injection valve remote from the electrical plug connection 4. A valve seat body 9 is centrally disposed in this nozzle carrier 8.

A stroke ring 13 is provided on an annular step 11 recessed into the interior of the nozzle carrier 8. A residual air disc 14 is disposed against the stroke ring 13, and both elements are held in place by the force of pressure created by the flanging of the nozzle carrier 8 tightly onto the valve housing 1. The remnant air disc 14, which is manufactured of non-magnetic spring material, such as a cobalt-nickel-chrome alloy, extends radially at least partially over a bottom portion 15 of the valve housing 1 remote from the electrical plug connection 4, thus preventing a flat armature 17 from magnetically adhering to the bottom portion 15. A ball 16 is provided as the movable valve element; it is firmly connected with the flat armature 17 and cooperates with a conically shaped fixed valve seat 18 disposed in the valve seat body 9. The supply of fuel, such as gasoline, is effected via a central fuel inflow nozzle 21, which simultaneously acts as the core upon which the coil carrier 2 is disposed. A tubular insert 23 is coaxially disposed in the inflow bore 22 of the fuel inflow nozzle 21. A closing spring 24 is provided between the end of the tubular insert 23 adjacent the flat armature 17 and the flat armature 17. In the non-excited state of the magnetic element comprising the coil 3 and the bottom portion of the valve housing 15, this closing spring 24 presses the ball 16 against the valve seat 18 of the valve seat body 9, closing the valve. The fuel flowing into the fuel injection valve via the fuel inflow nozzle 21 proceeds through apertures 25 provided in the flat armature 17 to the actual valve means proper, comprising the valve seat body 9, the valve seat 18 and the ball 16. From the valve means, the fuel can flow past the outer circumference of the flat armature 17, for instance via recesses 27 in the residual air disc 14 and via apertures 28 in the bottom portion 15 of the valve housing 1, into a coil chamber 29 disposed between the magnetic coil 3 and the valve housing 1. The coil chamber 29 communicates with a fuel return flow line, not shown, via a fuel outflow nozzle 31.

A spring tongue 35 is formed from a portion of the residual air disc 14. On an end extending radially inwardly from spring tongue clamping point 36 on the valve housing 1, the spring tongue 35 abuts the flat armature 17 on the side 32 thereof remote from the fixed valve seat 18, and is positively connected thereto by soldering or welding. The flat armature 17 may thus execute a pivoting movement about the spring tongue clamping point 36 on the housing 1.

Alternatively, the spring tongue 35 need not absolutely be shaped out of the body of the residual air disc 14; it may instead be a separate element comprising a piece of spring sheet metal clamped such that it is positively attached to the housing. As a result of the unitary affixation of the flat armature 17 to the spring tongue 35, one is assured that the flat armature 17 can execute only a pivoting movement, and that pivot occurs exclusively about the spring tongue clamping point 36.

When the coil assembly assumes the excited state, the flat armature 17 is attracted by the magnetic coil 3, so that the ball 16 then moves to reveal a flowthrough cross section opposite the valve seat 18, by way of which the fuel can flow into a bore 38 provided in the valve seat body 9. A charge controlling device in the form of an insert 41 having fluted section 40 is pressed into the bore 38. The overall diameter of the charge controlling device is slightly larger than the guide bore 38 and the lands 40*a* and grooves of the flutes 40 provided therebetween extend axially in the direction of fuel flow. Accordingly, when the device 41 is seated in the bore 38 the lands are sealed in contact with the wall of the bore. A metering section 42 adjoins the fluted section 40 of the insert 41 in the flow direction. The metering section has a smaller diameter than the guide bore 38, so that between the circumference of the metering section 42 and the wall of the guide bore 38, a metering cross section 43 is formed which effects throttling and serves the purpose of fuel metering. The metering section 42 may be embodied cylindrically, as shown in FIGS. 1 and 2, or conically, as indicated in FIG. 3 at 44, preferably with the increasing diameter extending in the direction of fuel flow. The metering section 42, 44 is adjoined in the flow direction by a shelf section 45 or 46 which shapes the injection stream. As marked at 45 in FIG. 2, this section diverts the fuel, flowing out via the metering cross section 43, at right angles to the flow direction, thus serving as an impact plate, while the section 46 shown in FIGS. 1 and 3, being embodied in conical shape with a diameter that increases in the flow direction, results in a fuel injection cone whose shape is dependent on the cone 46. The section 45, 46 shaping the injection stream assures good preparation of the injected fuel.

Fuel is normally fed from a pump in fuel injection systems of this type under a pressure of between 2000–4000 psi. Thus, it is believed that it will clear that the fuel which is under such an elevated pressure is first squeezed through the grooves in a plurality of streams and with the fuel still under considerable pressure it passes the stub 42 and reaches the shelf area 45 and is impelled radially outwardly in a fan type stream into the intake tube.

In the embodiment of the invention shown in FIGS. 1 and 3 the charge controlling device is provided with the same lands 40*a* and grooves 40, however there is little or no commingling since the parallel axially downwardly flowing streams are directed against the canted surface 46 and then fan outwardly in a thin stream into the combustion chamber. It will be noted that the annular canted surface 46 is spaced from the vanes on the charge controlling device by a frustoconical body 44. Naturally, it is to be understood that both of the charge controlling devices are made as integral elements although the machining operation of each element is different. The bore 38 and the charge controlling device 41 are optimized in such a fashion that a smallest possible detrimental volume exists downstream of the valve seat 18.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. An injection valve for fuel injection systems of internal combustion engines, said injection valve including a movable valve element engageable with a fixed valve seat disposed in a valve seat body, said valve seat body having an axial bore extending downstream of said fixed valve seat, said bore providing an annular wall adapted to receive a charge controlling device comprising an insert having a fluted section consisting of lands and grooves, said insert lands engaging the bore wall to secure the charge controlling device in said bore and said grooves providing a plurality of axially extending fuel flow dividing pathways through said bore, and diversion means downstream of said charge controlling device serving to divert fluid flow from said bore into a fan-type spray for injection into an intake tube of said engine.

2. An injection valve as defined by claim 1, in which: said diversion means downstream of said charge controlling device terminates in a circular shelf area.

3. An injection valve as defined by claim 1 in which: said diversion means downstream of said charge controlling device has a conical portion.

4. An injection valve as defined by claim 3, in which said conical portion includes an annular canted surface which terminates in a thin edge.

5. An injection valve as defined by claim 2, in which the circular shelf area of said diversion means downstream of said charge controlling device has a diameter greater than said annular wall of said bore.

6. An injection valve as defined by claim 3, in which: said diversion means downstream of said charge controlling device has a conical shape which increases in the direction of fuel flow.

7. An injection valve as defined by claim 4, in which: said diversion means downstream of said charge controlling device has a conical shape which increases in the direction of fuel flow.

* * * * *